US008505735B2

(12) United States Patent
Han et al.

(10) Patent No.: US 8,505,735 B2
(45) Date of Patent: Aug. 13, 2013

(54) VERTICAL RING MAGNETIC SEPARATOR FOR DE-IRONING OF PULVERIZED COAL ASH AND METHOD USING THE SAME

(75) Inventors: Jianguo Han, Beijing (CN); Zhaohua Guo, Bejing (CN); Wenhui Zhang, Beijing (CN); Cundi Wei, Beijing (CN); Yongwang Wang, Beijing (CN); Shaonan Xu, Beijing (CN); Sa Lv, Beijing (CN); Hong Dong, Beijing (CN); Junzhou Chi, Beijing (CN); Jianmin Zhang, Beijing (CN); Qingan Nan, Beijing (CN)

(73) Assignee: China Shenhua Energy Company Limited, Beijing (CN)

( * ) Notice: Subject to any disclaimer, the term of this patent is extended or adjusted under 35 U.S.C. 154(b) by 0 days.

(21) Appl. No.: 13/579,306

(22) PCT Filed: Feb. 23, 2011

(86) PCT No.: PCT/CN2011/071207

§ 371 (c)(1),
(2), (4) Date: Oct. 15, 2012

(87) PCT Pub. No.: WO2011/103803

PCT Pub. Date: Sep. 1, 2011

(65) Prior Publication Data

US 2013/0043167 A1 Feb. 21, 2013

(30) Foreign Application Priority Data

Feb. 23, 2010 (CN) ..... 2010 1 0112520
Apr. 27, 2010 (CN) ..... 2010 1 0161869

(51) Int. Cl.
*B03C 1/03* (2006.01)

(52) U.S. Cl.
USPC ..... 209/39; 209/223.1; 209/225; 209/232

(58) Field of Classification Search
USPC ..... 209/39, 213, 214, 222, 223.1, 225, 209/226, 228, 232; 210/222, 223, 695
See application file for complete search history.

(56) References Cited

U.S. PATENT DOCUMENTS 3,375,925 A * 4/1968 Carpenter ..... 209/214
3,887,458 A * 6/1975 Laurila ..... 209/219

(Continued)

FOREIGN PATENT DOCUMENTS

CN 2557233 6/2003
CN 1994578 7/2007

(Continued)

OTHER PUBLICATIONS

International Search Report, Application No. PCT/CN2011/071207, mailed Jun. 2, 2011.
Form PCT/ISA/237 for International Application No. PCT/CN2011/071207, dated Jun. 2, 2011.

(Continued)

*Primary Examiner* — Joseph C Rodriguez
(74) *Attorney, Agent, or Firm* — Renner, Otto, Boisselle & Sklar, LLP

(57) ABSTRACT

A vertical ring magnetic separator for de-ironing of coal ash comprises a rotating ring (101), an inductive medium (102), an upper iron yoke (103), a lower iron yoke (104), a magnetic exciting coil (105), a feeding opening (106), a tailing bucket (107) and a water washing device (109). The feeding opening (106) is used for feeding the coal ash to be de-ironed, and the tailing bucket (107) is used for discharging the non-magnetic particles after de-ironing. The upper iron yoke (103) and the lower iron yoke (104) are respectively arranged at the inner and outer sides of the lower portion of the rotating ring (101). The water washing device (109) is arranged above the rotating ring (101). The inductive medium (102) is arranged in the rotating ring (101). The magnetic exciting coil (105) is arranged at the periphery of the upper iron yoke (103) and the lower iron yoke (104) so as to make the upper iron yoke (103) and the lower iron yoke (104) to be a pair of magnetic poles for generating a magnetic field in the vertical direction, wherein the inductive medium (102) is layers of steel plate meshes, each steel plate mesh is woven by wires, and ridge-shape sharp corners are formed at the edges of the wires. A method for magnetically separating and de-ironing of coal ash, utilizes the vertical ring magnetic separator for de-ironing of coal ash. By adopting the vertical ring magnetic separator and the method of magnetic separation for de-ironing, the de-ironing efficiency is improved by at least 20%.

20 Claims, 5 Drawing Sheets

(56) References Cited

U.S. PATENT DOCUMENTS

| | | | | |
|---|---|---|---|---|
| 4,046,680 | A * | 9/1977 | Fritz | 209/214 |
| 4,153,542 | A * | 5/1979 | Bender et al. | 209/223.1 |
| 4,166,789 | A * | 9/1979 | Imai et al. | 209/219 |
| 4,455,228 | A * | 6/1984 | Jones | 210/222 |
| 4,737,294 | A * | 4/1988 | Kukuck | 210/695 |
| 4,874,508 | A * | 10/1989 | Fritz | 209/214 |
| 5,462,173 | A * | 10/1995 | Darling | 209/39 |
| 6,149,014 | A * | 11/2000 | Mankosa et al. | 209/223.2 |
| 7,886,913 | B1 * | 2/2011 | Fritz et al. | 209/224 |
| 8,292,084 | B2 * | 10/2012 | Chappie et al. | 209/39 |
| 2003/0183580 | A1 | 10/2003 | Schaaf et al. | |

FOREIGN PATENT DOCUMENTS

| | | |
|---|---|---|
| CN | 201179479 | 1/2009 |
| CN | 201220185 | 4/2009 |
| CN | 201235309 | 5/2009 |
| CN | 101786041 | 7/2010 |
| CN | 101869870 | 10/2010 |
| CN | 201613174 | 10/2010 |
| JP | 10024248 | 1/1998 |

OTHER PUBLICATIONS

International Preliminary Report on Patentability, Application No. PCT/CN2011/071207, dated May 4, 2012.

* cited by examiner

VERTICAL RING MAGNETIC SEPARATOR FOR DE-IRONING OF PULVERIZED COAL ASH AND METHOD USING THE SAME

This application is a national phase of International Application No. PCT/CN2011/071207 filed Feb. 23, 2011.

TECHNICAL FIELD

The present invention relates to a magnetic separation apparatus and method, and in particular relates to a vertical ring magnetic separator for de-ironing of coal ash and a method of magnetic de-ironing by using the magnetically separator.

BACKGROUND ART

The coal ash is a waste discharged from the coal-combustion power station. The discharge of the coal ash not only occupies a large amount of land, but also pollutes the environment seriously. How to handle and utilize the coal ash becomes a very important problem. The coal ash contains a number of components that can be utilized, such as aluminum oxide, silicon oxide and the like. These useful components, if being extracted, can facilitate a highly efficient complex utilization for the coal ash.

However, during extracting of the useful components of the coal ash, the existence of iron oxide contained in the ash will affect the purity of the extracts. Therefore, it is of great importance to remove iron from the coal ash, for improving the purity of the useful components and improving the complex utilization for the coal ash.

The method of magnetic separation generally used for removing iron from the coal ash is mainly dry magnetic separation, i.e. passing the coal ash through a powerful magnetic separator directly. However, in case of low content of iron impurities (when the content of iron oxide is lower than 5%) in the coal ash, as it is difficult to separate the iron impurities with other coal ash particles, it is thus difficult to remove the iron impurities completely. Therefore, for the coal ash having low iron content, the de-ironing effect by prior methods is unsatisfactory.

Currently, vertical ring magnetic separators are used to select from weak magnetic Iron ore for finally obtaining Iron ore having a certain grade as required. Therefore, their structure and magnetic field strength are designed with respect mainly to iron selecting, not de-ironing. The prior vertical ring magnetic separators have the circular rod shaped stainless steel media as magnetic media, which have relatively large spacing therebetween so as to avoid blocking of the medium rod by the iron ore during magnetically separating. However, during magnetic de-ironing from the coal ash, the spacing between the media is too large, thus the particles in the coal ash which have small granularity and relatively weak magnetism would pass through the media, rather than adsorb by the media, thus decreasing the effect of magnetic separation.

In the traditional magnetic separation applications, the structure of vertical ring magnetic separators are configured to be fed from its upper portion and discharged from its lower portion. However, during de-ironing of the coal ash, as the iron-containing mineral have a relatively weak magnetism, if such upper portion feeding means is employed, it is possible for the iron-containing mineral to penetrate through the media under gravity, rather than being adsorbed, thus further decreasing the effect of magnetic de-ironing.

Therefore, it is necessary to design a new magnetic separation apparatus to overcome the above disadvantageous.

SUMMARY

With respect to the prior defects, the objectives of the present invention are to provide an apparatus and a method of magnetic separation to better remove iron-containing mineral from the coal ash.

The vertical ring magnetic separator of the invention for de-ironing from coal ash comprises a rotating ring, an inductive medium, an upper iron yoke, a lower iron yoke, a magnetic exciting coil, a feeding opening, a tailing bucket and a water washing device, wherein the feeding opening is used for feeding the coal ash to be de-ironed, the tailing bucket is used for discharging the non-magnetic particles after de-ironing, the upper iron yoke and the lower iron yoke are respectively arranged at the inner and outer sides of the lower portion of the rotating ring, the water washing device is arranged above the rotating ring, the inductive medium is arranged in the rotating ring, the magnetic exciting coil is arranged at the periphery of the upper iron yoke and the lower iron yoke so as to make the upper iron yoke and the lower iron yoke to be a pair of magnetic poles for generating a magnetic field in the vertical direction, wherein the inductive medium is layers of steel plate meshes, each steel plate mesh is woven by wires, and the edges of the wires have prismatic sharp angles.

Preferably, the upper iron yoke and the lower iron yoke are formed integrally, and are arranged, in a plane perpendicular to the rotating ring, to surround the inner and outer sides of the lower portion of the rotating ring.

Preferably, the vertical ring magnetic separator further comprises a pressure balance chamber water jacket disposed adjacent to the magnetic exciting coil.

Preferably, the steel plate mesh is made of 1Cr17.

Preferably, the magnetic exciting coil is a flat wire solenoid coil which is double glass envelope enamelled aluminum.

Preferably, the steel plate mesh has a medium layer spacing of 2-5 mm. More preferably, the steel plate mesh has a medium layer spacing of 3 mm.

Preferably, the steel plate mesh has a thickness of 0.8-1.5 mm, a mesh grid size of 3 mm×8 mm-8 mm×15 mm, and a wire width of 1-2 mm. More preferably, the steel plate mesh has a thickness of 1 mm, a mesh grid size of 5 mm×10 mm, and a wire width of 1.6 mm.

Preferably, the vertical ring magnetic separator further comprises a pulsating mechanism, which is coupled with the tailing bucket via a rubber plate.

Preferably, the inductive medium is provided in the entire circle of the rotating ring.

The present invention further provides a method for magnetic de-ironing of coal ash with the above-said vertical ring magnetic separator, the method comprises:

a. preparing the coal ash as a slurry having a predetermined solid content;
b. magnetically separating the slurry by the vertical ring magnetic separator;
c. measuring the Fe content in the slurry after magnetically separating;
d. when the Fe content in the magnetically separated slurry is lower than or equal to a predetermined content, discharging the slurry; when the Fe content in the magnetically separated slurry is higher than the predetermined content, returning the slurry to step b for magnetically separating the slurry by the vertical ring magnetic separator once more.

Preferably, the vertical ring magnetic separator provides a magnetic field strength of at least 15,000 Gs.

Preferably, when magnetically separating the slurry by the vertical ring magnetic separator, the vertical ring magnetic separator provides a magnetic field strength of 15,000-20,000 Gs.

Preferably, the method further comprises: e. pressure-filtering the discharged slurry to obtain a filtered cake.

Preferably, in step a, preparing the coal ash as the slurry having the solid content of 20-40 wt %.

Preferably, the discharged slurry is pressure-filtered by a plate-and-frame filter press to form the filtered cake having the solid content of 60-80 wt %.

By means of the magnetic separation apparatus and the method of the present invention, in case of relatively low content of Fe impurities in the coal ash, the Fe impurities are removed more completely. Compared with the prior method for de-ironing of coal ash, the Fe removing efficiency is improved by at least 20%, thus significantly relieving the burden of de-ironing from solution in the subsequent processes, thereby reducing the production cost and improving the production efficiency.

BRIEF DESCRIPTION OF THE DRAWINGS

FIG. 3(*c*) is an enlarged schematic diagram of the characteristic straight line in FIG. 3(*a*)

DETAILED DESCRIPTION OF THE EMBODIMENTS

Figure 1:
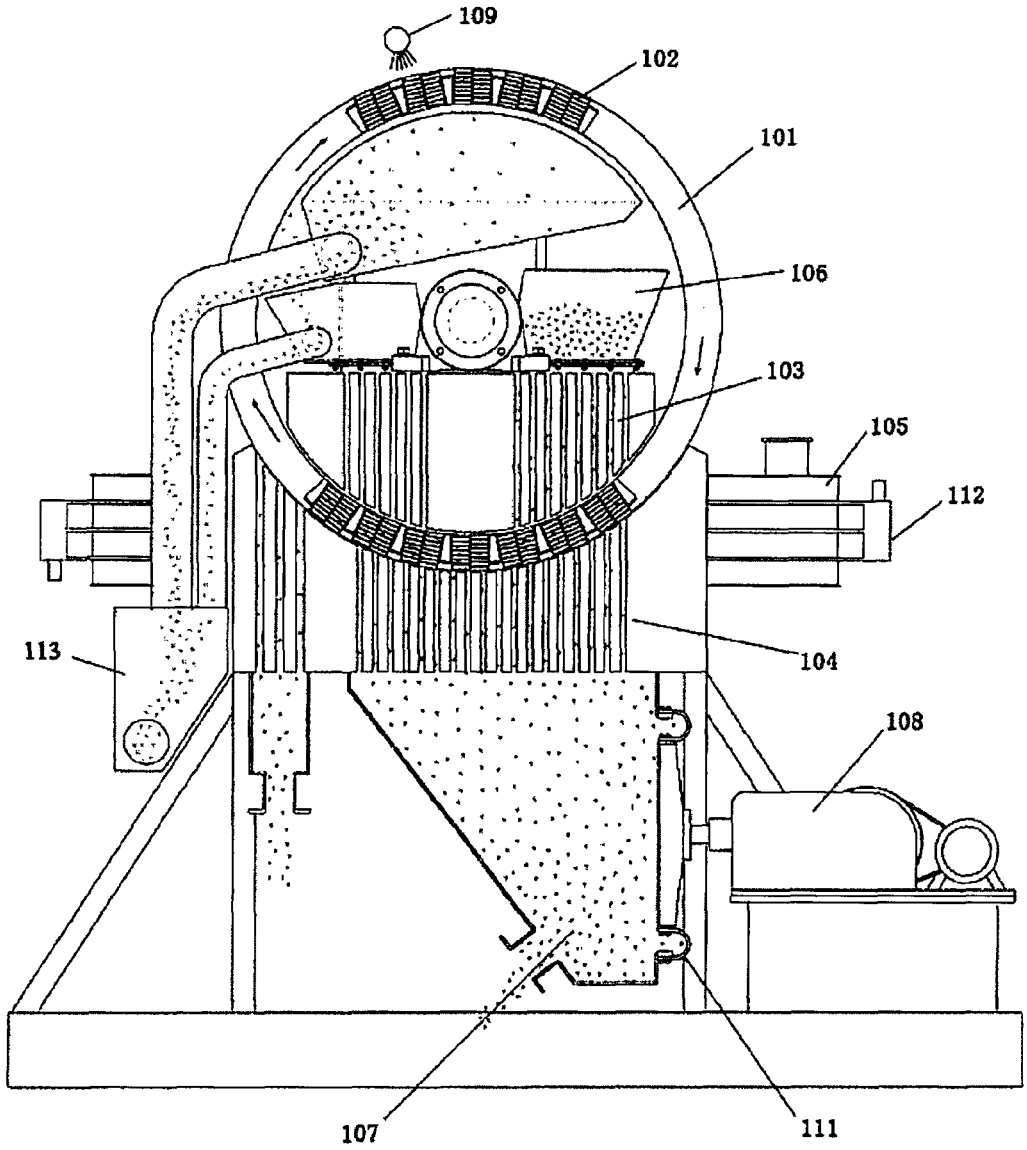
FIG. 1 is a schematic structural diagram of the vertical ring magnetic separator for de-ironing of coal ash of the present invention.
Figure 2:
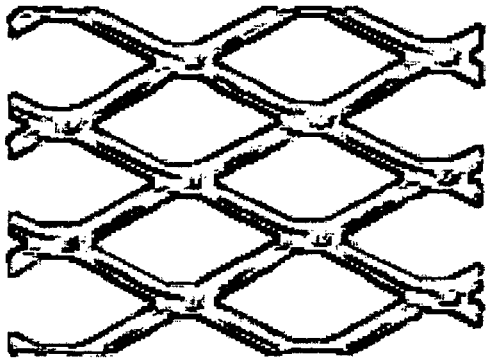
FIG. 2 is a schematic structural diagram of the steel plate mesh as the inductive medium in the present invention.

As shown in FIG. 1, the vertical ring magnetic separator of the present invention for de-ironing of coal ash comprises a rotating ring 101, an inductive medium 102, an upper iron yoke 103, a lower iron yoke 104, a magnetic exciting coil 105, a feeding opening 106 and a tailing bucket 107, and also comprises a pulsating mechanism 108 and a water washing device 109.

The rotating ring 101 is a circular ring shaped carrier in which the inductive medium 102 is carried. When the rotating ring 101 is rotated, the inductive medium 102 and the matters adsorbed thereon move together, so as to separate the adsorbed matters. The rotating ring 101 may be made of any suitable material, such as carbon steel etc.

An electric motor or other driving device can provide power to the rotating ring 101 such that the rotating ring 101 can rotate in a set speed. Preferably, in a preferred embodiment of the present invention, the rotating speed of the rotating ring 101 is continuously adjustable. It can be adjusted depending on species of raw materials or different feeding conditions for a same raw material for achieving the best separating effect.

When parameters, such as iron content or treating amount of the material to be treated is lower than a predetermined value, a relatively low rotating speed, such as 3 rpm, may be used, in order to make the ferromagnetic impurities having sufficient time to be adsorbed onto the inductive medium meshes under the act of magnetic field, and being separated. Driving the rotating ring 101 with a relatively low rotating speed may also reduce mingling of non-magnetic mineral matter (such as the coal ash particles) into the concentrate, thus improving the yield of the concentrate.

The upper iron yoke 103 and the lower iron yoke 104 are arranged at the inner and outer sides of the lower portion of rotating ring 101 as magnetic poles. Preferably, the upper iron yoke 103 and the lower iron yoke 104 are formed integrally, and are arranged, in a plane perpendicular to the rotating ring, to surround the inner and outer sides of the lower portion of rotating ring.

The inductive medium 102 is arranged in the rotating ring 101, and preferably in the entire circle of the rotating ring 101. As the magnetic exciting coil 105 is arranged at the periphery of the upper iron yoke and the lower iron yoke, the magnetic field generated by the magnetic exciting coil 105 makes the upper iron yoke 103 and the lower iron yoke 104 to be a pair of magnetic poles generating magnetic field along the vertical direction. The upper iron yoke 103 and the lower iron yoke 104 are arranged at the inner and outer sides of the lower portion of the rotating ring 101 such that the rotating ring 101 rotates between the magnetic poles. When the rotating ring 101 rotates, the inductive medium 102 in the rotating ring 101 will pass the pair of magnetic poles made up of the upper iron yoke 103 and the lower iron yoke 104 and be magnetized for removing the iron.

In a preferred embodiment of the invention, the inductive medium 102 may be layers of steel plate meshes. The steel plate meshes are made of stainless steel, and preferably made of 1Cr17. Each layer of steel plate meshes is woven by stainless steel wires, with the mesh grid having a rhomb shape. The edges of the wires have prismatic sharp angles.

For the steel plate meshes as the inductive medium 102, since the edges of the wires have sharp angular shape, so the magnetic fields at these tips of the medium is stronger, thus resulting in better magnetic separation effect.

Preferably, in the present invention, the steel plate meshes have a medium layer spacing of 2-5 mm. More preferably, the steel plate meshes have a medium layer spacing of 3 mm. Preferably, the steel plate mesh has a thickness of 0.8-1.5 mm, a mesh grid size of 3 mm×8 mm-8 mm×15 mm, and a wire width of 1-2 mm. As the spacing between the layers of the inductive medium 102 is decreased, it is possible for the coal ash particles contact the inductive medium 102 directly, thus preventing the magnetic particles penetrating the medium and thereby not being removed.

In a preferred embodiment of the invention, the magnetic exciting coil 105 is formed of flat wire solenoid coil which is double glass envelope enamelled aluminum. The flat wire solenoid coil is solid conductor, which, compared with the traditional hollow copper tube electric magnetic coil, significantly improves the duty ratio, enhances the magnetism aggregation effect, improves the magnetic field distribution, and reduces the power consumption. The current passing through the magnetic exciting coil 105 is continuously adjustable, and thus the magnetic field strength is also continuously adjustable.

Preferably, the vertical ring magnetic separator for de-ironing of coal ash of the present invention further comprises a pulsating mechanism 108 coupled with the tailing bucket 107 via a rubber plate 111. The pulsating mechanism can be achieved by an eccentric link mechanism. As the pulsating mechanism 108 is coupled with the tailing bucket 107 via the rubber plate 111 such that the alternating force generated by the pulsating mechanism 108 pushes the rubber plate 111 to move forth and back, it is possible for the mineral slurry in the tailing bucket 107 to generate pulsations.

The water washing device 109 is arranged above the rotating ring 101, for flushing the magnetic particles into the concentrate hopper 113 by water flow. The water washing device 109 may be various suitable flushing or spraying device, such as a spraying nozzle, water pipe, etc.

The feeding opening 106 may be a feeding hopper or a feeding pipe. The feeding opening 106 is configured for feeding the mineral slurry, such that the mineral slurry enters the upper iron yoke 103 with a relatively small fall for preventing the magnetic particles from penetrating the inductive medium 102 due to gravity, thus improving the effect of magnetically separating and impurities removing.

Preferably, the vertical ring magnetic separator further comprises a cooling device 112, which is provided adjacent to the magnetic exciting coil for decreasing the working temperature of the magnetic exciting coil. The cooling device is a pressure balance chamber water jacket.

When the vertical ring magnetic separator for generating the strong magnetic field is working, the magnetic exciting coil 105 generates large amount of heat, potentially causing the coil overheated to be burned and damaged, which is the most dangerous hidden trouble to the magnetic separator. It is always a technical difficulty for how to better dissipate the heat such that the temperature of the coil can be decreased as low as possible. In the present invention, the pressure balance chamber water jacket is employed as the cooling device, avoiding the disadvantages in the prior cooling manners and ensuring a safe and stable running of the vertical ring magnetic separator.

The pressure balance chamber water jacket is made of stainless steel material, and thus is not prone to scale. As pressure balance chambers are respectively mounted to the inlet and outlet of the water jacket, they ensure that the water flows uniformly through each layer of water jacket and fills throughout the inside of the jacket, thus preventing any local water from taking a shortcut which otherwise would affect heat dissipation. Each layer of water jacket has a water passage with a large cross-section area, and thus it is possible to completely avoid blocking due to scaling. Even if there is a block somewhere, the normal flowing of the circulating water in the water jacket will not be affected. Moreover, the water jacket is in close contact with the coil by a large contacting area, thus most heat generated by the coil can be taken away by the water flow.

The pressure balance chamber water jacket, as compared with the common hollow copper tube for heat dissipation, shows high heat dissipation efficiency, small temperature rise of the windings, and low exciting power. In case of a rated exciting current of 40 A, the exciting power for a magnetic separator with a common hollow copper tube for heat dissipation is 35 kw, while for the magnetic separator with the pressure balance chamber water jacket for heat dissipation is 21 kw.

When the magnetic separator apparatus is working, the fed mineral slurry flows along a slot of the upper iron yoke 103 then through the rotating ring 101. As the inductive medium 102 in the rotating ring 101 is magnetized in the background magnetic field, magnetic field with very high gradient is formed at the surface of the inductive medium 102. The magnetic particles in the mineral slurry, under the effect of the very high magnetic field, are adhered to the surface of the inductive medium 102, and rotated with the rotating ring 101 going into the region without magnetic field at top of the rotating ring 101. Then, the magnetic particles are flushed into the concentrate hopper by the water washing device 109 located above the top of the rotating ring. The non-magnetic particles flow along the slots of the lower iron yoke 104 into the tailing bucket 107 and then are discharged via a tailing exit of the tailing bucket 107.

Comparing the steel plate mash medium with the rod-shape medium having the same weight, the surface area of the steel plate mash medium is 6 times larger than that of the rod-shape medium. Thus, the steel plate mash medium has significantly improved magnetically adsorption ability, significantly improved possibility of the magnetic matters to be adsorbed, and significantly improved magnetic field strength and gradient induced at the ridge corner of the steel plate mesh compared with the rod-shape medium.

Figure 3A:
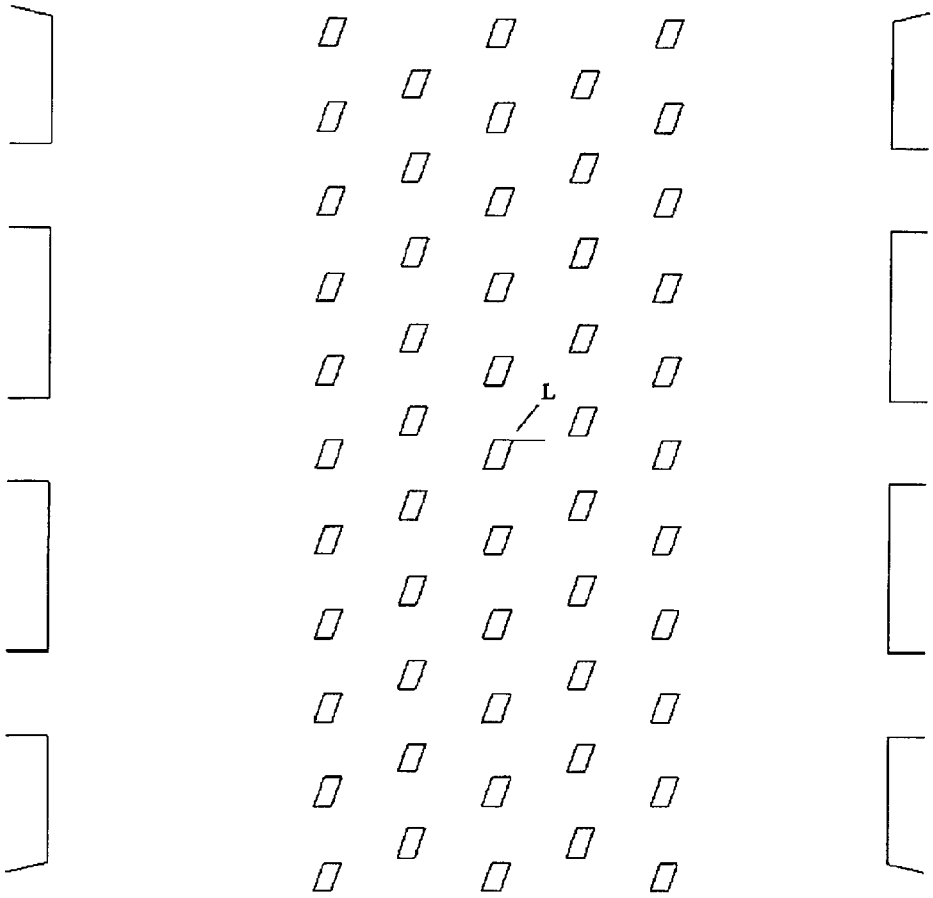
FIGS. 3(*a*) and 3(*b*) are diagrams show the effect of simulation calculation for the inductive field strength in the inductive region varying with a straight line when the steel plate mesh is used as the inductive medium.
Figure 3B:
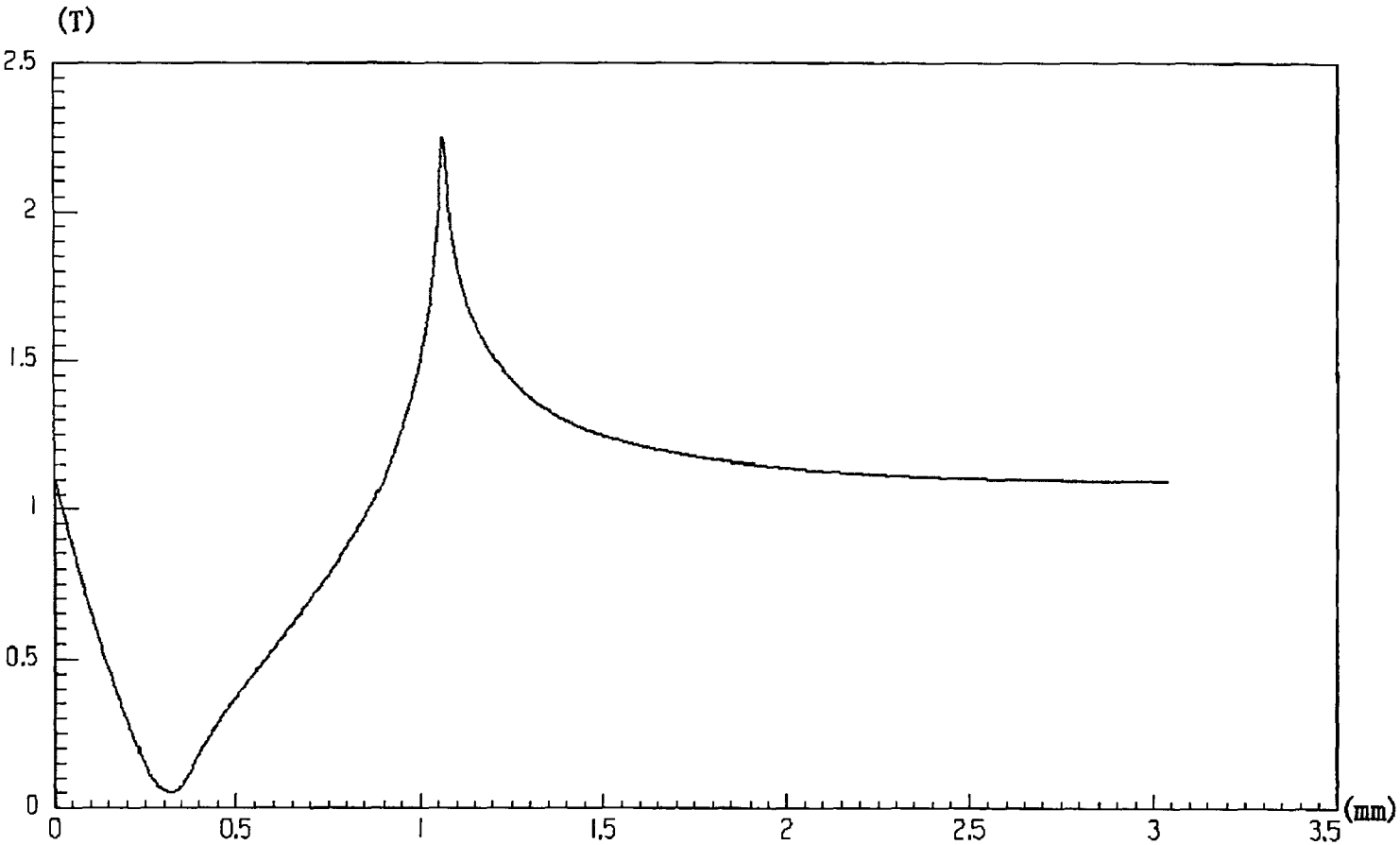
Figure 3C:
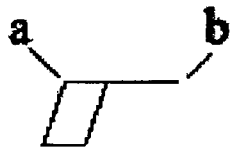

For the vertical ring magnetic separator of the present invention, the distribution diagram of the magnetic field utilizing the steel plate mesh inductive medium layers is shown in FIG. 3(*a*). Each vertical column of small parallelograms represents a cross-section of one layer of the medium mesh. In this Figure, the case of five layers of magnetic field medium meshes is simulated, in which the cross-section of the mesh grid formed by the wires is a parallelogram. Taking the small parallelogram in the middle as an example, as shown in the Figure, a characteristic straight line L is made on the parallelogram. FIG. 3(*b*) shows the field strength variation law of the inductive field strength along the specific straight line from point a to point b (referring to FIG. 3(*c*)) by simulation calculation. It can be seen that its tip generates the maximum inductive field strength of up to 22,000 Gs, i.e. 2.2 T.

The above-mentioned simulation calculation for the magnetic field is achieved by using the software of Ansoft Maxwell 10. The Ansoft Maxwell 10 is electromagnetic analysis software of Ansoft Company, performs finite elements analysis mainly based on the Maxwell Equation, and is a powerful functional electromagnetic field simulation tool. It is used mainly for analyzing 2D and 3D electro-magnetic components, such as an electric motor, a transformer, an exciter as well as other electrical and electromechanical equipments, and has application areas over automobile, military, space navigation and industry applications, etc.

Figure 4:
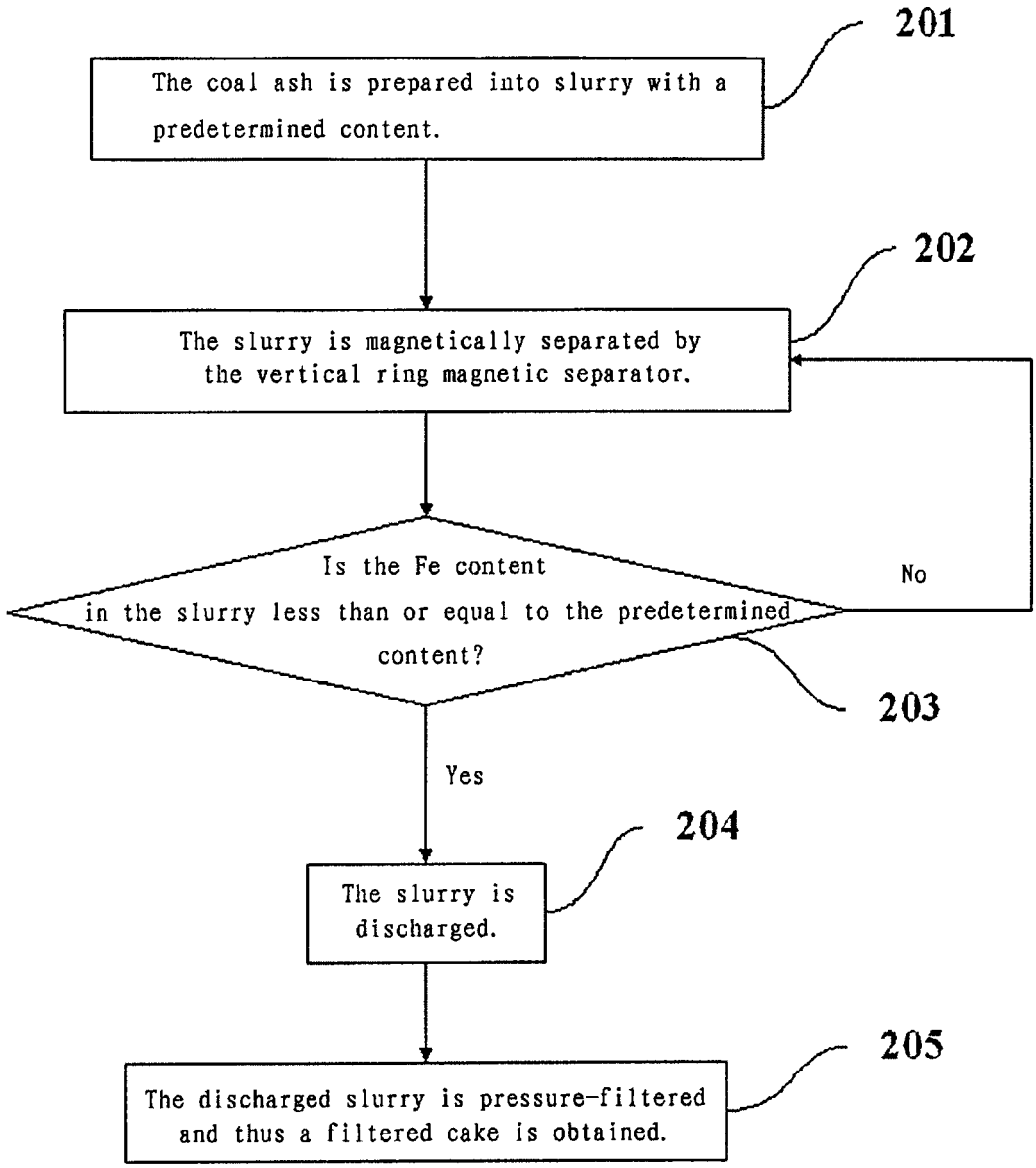
FIG. 4 is a flowchart of the method for de-ironing according to an embodiment of the present invention.

In a preferred embodiment of the invention, a method of magnetic separation for de-ironing of coal ash by using the vertical ring magnetic separator as provided in the present invention is shown in FIG. 4, and preferably comprises the following steps.

For the material of coal ash having relatively large granularity, preferably the coal ash is crushed to have a predetermined granularity, such as less than 2 mm.

In step 201, the coal ash is prepared into slurry with a predetermined content. Preferably, the coal ash is added with water to form slurry having a solid content of 20-40 wt %.

In step 202, the slurry, prepared to have the predetermined solid content, is magnetically separated by the vertical ring magnetic separator. Preferably, the vertical ring magnetic separator provides field strength of 15,000-20,000 Gs.

In step 203, the Fe content in the slurry after magnetically separating is measured. The Fe content can be measured by sampling the slurry, drying the sample, and then measuring the Fe ion content in the sample. Various suitable chemical testing methods or apparatuses can be used for measuring Fe ion content.

When the Fe content in the slurry is lower than or equal to a predetermined content, the slurry is discharged at step 204; while when the Fe content in the slurry is higher than the predetermined content, the slurry is returned to step 202, and magnetically separating the slurry by the vertical ring magnetic separator repeatedly. The predetermined content may be determined by considering the balance of the quality requirements to the products and the magnetic separation cost. Preferably, the predetermined content of iron oxide is 0.8 wt %, that is, when the measured iron oxide content is lower than or equal to 0.8 wt %, the slurry is discharged.

Preferably, in step 205, the discharged slurry is pressure-filtered and thus a filtered cake is formed. The pressure-filtering can be performed by a plate-and-frame filter press. Preferably, after the pressure-filtering, the filtered cake having the solid content of 60-80 wt % is formed.

Example 1

Of the vertical ring magnetic separator of the present invention, in which:

the vertical ring magnetic separator has a background magnetic field strength of 12,000 Gs, an exciting current of 40 A, and steel plate meshes made of 1Cr17 with medium layer spacing of 3 mm, thickness of 1 mm, mesh grid size of 5 mm×10 mm, wire width of 1.6 mm and ridge corner oriented upward. In this case, the node strength of network media can be up to 22,000 Gs, which is 20% higher than the traditional vertical rotary ring inductive wet magnetic separator.

Example 2

The vertical ring magnetic separator has background magnetic field strength of 12,000 Gs, exciting current of 40 A, and steel plate meshes made of 1Cr17 with medium layer spacing of 2 mm, thickness of 1 mm, mesh grid size of 3 mm×8 mm, wire width of 1 mm and a ridge corner oriented upward. In this case, the mesh-shape medium node field strength can be up to 20,000 Gs.

Example 3

The vertical ring magnetic separator has background magnetic field strength of 12,000 Gs, exciting current of 50 A, and steel plate meshes made of 1Cr17 with medium layer spacing of 5 mm, thickness of 1.5 mm, mesh grid size of 5 mm×10 mm, wire width of 2 mm and ridge corner oriented upward. In this case, the mesh-shape medium node field strength can be up to 22,000 Gs.

In the Examples of the method of magnetic separation of the present invention, the fluidized bed coal ash, as the raw material, has the chemical ingredients as shown in Table 1 (unit: wt %).

TABLE 1

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 34.70 | 46.28 | 1.48 | 3.61 | 0.21 | 1.54 | 0.22 | 0.39 | 0.17 | 7.17 | 1.32 | 97.09 |

Example 4

Fluidized bed ash was added with water to form the slurry having a solid content of 33 wt %, which was magnetically separated under a magnetic field of 17,500 Gs by the vertical ring magnetic separator of the present invention. After each magnetic separation, 10 g of the magnetically separated slurry was taken, and died at 110° C., then the contents (wt %) of trivalent Fe ion ($TFe_2O_3$) and bivalent Fe ion (FeO) were measured. After three magnetically separating operations, the total Fe ions content was 0.7 wt %, lower than the predetermined value of 0.8 wt %. The slurry is discharged, and the discharged slurry was pressure-filtered by plate-and-frame filter press. After the pressure-filtering, the filtered cake having a solid content of 67.5 wt % was obtained. The filtered cake has the chemical compositions as shown in Table 2 (unit: wt %).

TABLE 2

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 35.22 | 48.07 | 1.43 | 4.24 | 0.19 | 0.52 | 0.18 | 0.38 | 0.17 | 8.04 | 1.32 | 99.76 |

Comparative Example 1

The fluidized bed coal ash as shown in Table 1 was magnetically separated by using a traditional magnetic separator. The traditional magnetic separator has circular rod shaped stainless steel medium as inductive medium, and a spacing between adjacent circular rod shaped stainless steel media is 20 mm. The magnetic separation was directly performed under magnetic field of 17,500 Gs generated by the circular rod shaped stainless steel media. After five magnetically separating operations, the chemical composition obtained after the dry magnetic separation is shown in Table 3 (unit: wt %).

TABLE 3

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 35.22 | 48.07 | 1.43 | 4.00 | 0.19 | 1.30 | 0.20 | 0.38 | 0.17 | 8.04 | 1.00 | 100 |

It can be seen that in the resulted product, the total Fe ions content is 1.5 wt %, more than twice than that in the product obtained by the method of magnetic separation for de-ironing of coal ash of the present invention.

Example 5

Fluidized bed ash was added with water to form the slurry having a solid content of 20 wt %, which was magnetically separated under a magnetic field of 15,000 Gs by the vertical ring magnetic separator of the present invention. After each magnetic separation, 10 g of the magnetically separated slurry was taken, and dried at 110° C., then the contents (wt %) of trivalent Fe ion ($TFe_2O_3$) and bivalent Fe ion (FeO) were measured. After three magnetically separating operations, the total Fe ions content was equal to the predetermined value of 0.8 wt %. The slurry was discharged, and the discharged slurry was pressure-filtered by plate-and-frame filter press. After the pressure-filtering, the filtered cake having a solid content of 75.0 wt % was obtained. The filtered cake has the chemical compositions as shown in Table 4 (unit: wt %).

TABLE 4

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 35.20 | 47.98 | 1.40 | 4.17 | 0.15 | 0.63 | 0.17 | 0.35 | 0.15 | 8.01 | 1.30 | 99.51 |

Comparative Example 2

The fluidized bed coal ash as shown in Table 1 was magnetically separated in a traditional magnetic separator. The traditional magnetic separator has circular rod shaped stainless steel medium as the inductive medium, and a spacing between the adjacent circular rod-shaped stainless steel media is 25 mm. The magnetic separation was directly performed under a magnetic field of 15,000 Gs generated by the circular rod shaped stainless steel media. After five magnetically separating operations, the chemical compositions obtained after the dry magnetic separation is shown in Table 5 (unit: wt %).

TABLE 5

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 35.20 | 47.98 | 1.40 | 4.00 | 0.15 | 1.26 | 0.20 | 0.35 | 0.15 | 8.01 | 1.30 | 100 |

It can be seen that in the resulted product, the total Fe ion content is 1.46 wt %, which is also significantly higher than that in the product obtained by the method of magnetic separation for de-ironing of coal ash according to the present invention.

Example 6

Fluidized bed ash was added with water to form the slurry having a solid content of 20 wt %, which was magnetically separated under a magnetic field of 20,000 Gs by the vertical ring magnetic separator of the present invention. After each magnetic separation, 10 g of the magnetically separated slurry was taken, and dried at 110° C., then the contents (wt %) of trivalent Fe ion ($TFe_2O_3$) and bivalent Fe ion (FeO) were measured. After three magnetically separating operations, the total Fe ions content was 0.75 wt %, lower than the predetermined value of 0.8 wt %. The slurry was discharged, and the discharged slurry was pressure-filtered by plate-and-frame filter press. After the pressure-filtering, the filtered cake having a solid content of 80.0 wt % was obtained. The filtered cake has the chemical compositions as shown in Table 6 (unit: wt %).

TABLE 6

| $SiO_2$ | $Al_2O_3$ | $TiO_2$ | CaO | MgO | $TFe_2O_3$ | FeO | $K_2O$ | $Na_2O$ | LOS | $SO_3$ | Total |
|---|---|---|---|---|---|---|---|---|---|---|---|
| 35.20 | 47.98 | 1.40 | 4.17 | 0.15 | 0.60 | 0.15 | 0.35 | 0.15 | 8.01 | 1.30 | 99.46 |

Though the present invention is described by means of the above preferable embodiments, its implementation forms are not limited to the above embodiments. It can be appreciated that for those skilled in the art, various changes and modifications may be made to the invention without departing from the spirit of the present invention.

The invention claimed is:

1. A vertical ring magnetic separator for de-ironing of coal ash, wherein, the vertical ring magnetic separator comprises a rotating ring, an inductive medium, an upper iron yoke, a lower iron yoke, a magnetic exciting coil, a feeding opening, a tailing bucket and a water washing device, wherein the feeding opening is used for feeding the coal ash to be de-ironed, the tailing bucket is used for discharging the non-magnetic particles after de-ironing, the upper iron yoke and the lower iron yoke are respectively arranged at the inner and outer sides of the lower portion of rotating ring, the water washing device is arranged above the rotating ring, the inductive medium is arranged in the rotating ring, the magnetic exciting coil is arranged at the periphery of the upper iron yoke and the lower iron yoke, so as to make the upper iron yoke and the lower iron yoke to be a pair of magnetic poles for generating a magnetic field in the vertical direction, wherein the inductive medium is layers of steel plate meshes, each steel plate mesh is woven by wires, and the edges of the wires have prismatic sharp angles, and the vertical ring magnetic separator provides a magnetic field strength of at least 15,000 Gs.

2. The vertical ring magnetic separator in accordance with claim 1, wherein the vertical ring magnetic separator further comprises a pressure balance chamber water jacket disposed adjacent to the magnetic exciting coil.

3. The vertical ring magnetic separator in accordance with claim 1, wherein the steel plate meshes are made of 1Cr17.

4. The vertical ring magnetic separator in accordance with claim 3, wherein the magnetic exciting coil is flat wire solenoid coil which is double glass envelope enamelled aluminum.

5. The vertical ring magnetic separator in accordance with claim 4, wherein the layer spacing of the steel plate meshes is 2-5 mm.

6. The vertical ring magnetic separator in accordance with claim 5, wherein the layer spacing of the steel plate meshes is 3 mm.

7. The vertical ring magnetic separator in accordance with claim 6, wherein the steel plate meshes have a thickness of 0.8-1.5 mm, a mesh grid size from 3 mm×8 mm to 8 mm×15 mm, and a wire width of 1-2 mm.

8. The vertical ring magnetic separator in accordance with claim 7, wherein the steel plate meshes have a thickness of 1 mm, a mesh grid size of 5 mm×10 mm, and a wire width of 1.6 mm.

9. The vertical ring magnetic separator in accordance with claim 8, wherein the vertical ring magnetic separator further comprises a pulsating mechanism coupled with the tailing bucket via a rubber plate.

10. The vertical ring magnetic separator in accordance with claim 1, wherein the inductive medium is provided in the entire circle of the rotating ring.

11. A method of magnetic separation for de-ironing of coal ash using the vertical ring magnetic separator according to claim 1, wherein the method comprises:

a. preparing the coal ash into a slurry having a predetermined solid content;

b. magnetically separating the slurry by the vertical ring magnetic separator;

c. measuring the Fe content in the slurry after magnetically separating;

d. when the Fe content in the slurry is lower than or equal to a predetermined content, discharging the slurry; when the Fe content in the slurry is higher than the predetermined content, returning the slurry to the step b, and magnetically separating the slurry by the vertical ring magnetic separator once more.

12. The method in accordance with claim 11, wherein the steel plate meshes are made of 1 Cr17.

13. The method in accordance with claim 11, wherein when magnetically separating the slurry by the vertical ring magnetic separator, the vertical ring magnetic separator provides a magnetic field strength of 15,000-20,000 Gs.

14. The method in accordance with claim 11, wherein the method further comprises:

e. pressure-filtering the discharged slurry to a filtered cake.

15. The method in accordance with claim 11, wherein in step a, the coal ash is prepared into the slurry having a solid content of 20-40 wt %.

16. The method in accordance with claim 11, wherein the magnetic exciting coil is a flat wire solenoid coil which is double glass envelope enamelled aluminum.

17. The method in accordance with claim 16, wherein the layer spacing of the steel plate meshes is 2-5 mm.

18. The method in accordance with claim 17, wherein the layer spacing of the steel plate meshes is 3 mm.

19. The method in accordance with claim 18, wherein the steel plate meshes have a thickness of 0.8-1.5 mm, a mesh grid size from 3 mm×8 mm to 8 mm×15 mm, and a wire width of 1-2 mm.

20. The method in accordance with claim 19, wherein the steel plate meshes have a thickness of 1 mm, a mesh grid size of 5 mm×10 mm, and a wire width of 1.6 mm.

* * * * *